United States Patent [19]

Meissner et al.

[11] Patent Number: 4,544,005

[45] Date of Patent: Oct. 1, 1985

[54] CAN DETECTION AND SWITCH MECHANISM FOR CAN FILLING APPARATUS

[75] Inventors: Konrad E. Meissner, Lafayette; John W. Colombo, Castro Valley, both of Calif.

[73] Assignee: Atlas Pacific Engineering Company, Emeryville, Calif.

[21] Appl. No.: 492,408

[22] Filed: May 6, 1983

[51] Int. Cl.[4] ..... B65B 3/04; B65B 57/04

[52] U.S. Cl. ..... 141/94; 141/142; 141/157; 200/61.09; 251/206; 251/251; 324/226

[58] Field of Search ..... 141/140–143, 141/156–162, 250–284, 1–12, 94–96, 192–198, 191; 200/61.09; 324/226; 251/251, 205, 206

[56] References Cited

U.S. PATENT DOCUMENTS

| | | | |
|---|---|---|---|
| 2,504,731 | 4/1950 | Rose et al. | 324/226 |
| 2,587,686 | 3/1952 | Berry | 324/226 |
| 2,620,923 | 12/1952 | Williams | 324/226 |
| 2,889,852 | 6/1959 | Dunlap | 251/206 |
| 2,909,197 | 10/1959 | Liley | 251/206 |
| 3,139,915 | 7/1964 | Minard | 141/141 |
| 4,369,821 | 1/1983 | Carter | 251/251 |

*Primary Examiner*—Houston S. Bell, Jr.
*Attorney, Agent, or Firm*—Ernest M. Anderson

[57] ABSTRACT

A filling apparatus for metal containers has a rotatable bowl carrying filling syrup or other fluid with a plurality of filling valves arranged on the bowl bottom around its periphery to fill empty containers moved into traveling engagement with each valve. A control cam manipulates each valve in a repeating sequence through close, vacuum, fill and vent positions. A switching cam follower tracking the control cam and a cooperating switch activate the valving sequence if a can is present at a particular filling valve and de-activate the sequence if a can is not present. A pneumatic cylinder actuated by series connected proximity sensors for metal objects, such as cans, manipulates the cooperating switch to direct the switching cam follower for each filler valve into one control cam tracking mode if an empty can is in place below the filler valve or into a second valve closing mode if a can is not present. One sensor detects filler valve position and the other sensor detects presence of a can by a change in the inductance of the sensor produced electric field. Concurrence of sensor outputs manipulates the cooperating switch.

5 Claims, 15 Drawing Figures

CAN DETECTION AND SWITCH MECHANISM FOR CAN FILLING APPARATUS

BACKGROUND OF THE INVENTION

This invention relates generally to vacuum syrupers or filling machines of the general type shown in U.S. Pat. Nos. 2,543,788 and 3,990,487 issued to Malcolm W. Loveland or in Battinich, U.S. Pat. No. 2,903,023. Those prior art machines have a plurality of filler valves such as that illustrated in FIG. 2 of U.S. Pat. No. 3,990,487 and in co-pending application Ser. No. 492,407 for High speed vacuum syruper.

One object of the present invention is to provide improved means for initiating or de-activating the valving sequence for a filling valve of the type illustrated in the foregoing U.S. Pat. No. 3,990,487 and co-pending application at high bowl speeds for filling in the order of 600 cans per minute.

SUMMARY OF THE INVENTION

The high speed vacuum syruper of the co-pending application includes a bowl containing filling syrup or other fluid which is rotatable upon a stationary frame. The bowl has a plurality of filling valves located around its bottom periphery and the machine includes means for moving an empty container into engagement with each filling valve, conveying it around with the filler valve during the filling operation and then removing it from the valve after filling for subsequent closure.

Each of the filling valves includes a ported valve seat mounted in an opening in the bowl bottom and an overlying ported valve disc pivotally mounted on the seat with a valve stem extending upwardly out of the rotatable bowl. The upper end of each valve stem oscillates in journal bearing means carried by the bowl rim and has a control cam follower mounted upon a crank fixed to the upper end of its valve stem. These control cam followers track a stationary cam on the machine frame for manipulating the valve disc so as to move its ports in relation to the corresponding ports in the valve seat in a repeating sequence through close, vacuum, fill and vent positions as the bowl rotates and carries the control cam followers along the stationary cam.

The principal object of the present invention is to provide means for sensing at a can detection station the presence or absence of a can positioned at a particular filling valve and upon sensing the latter condition for de-activating manipulation from its closed position for that particular valve.

Other objects and advantages of the invention will become apparent upon consideration of the following description of a preferred embodiment in connection with the accompanying drawings.

DESCRIPTION OF THE PREFERRED EMBODIMENT

Figure 2:
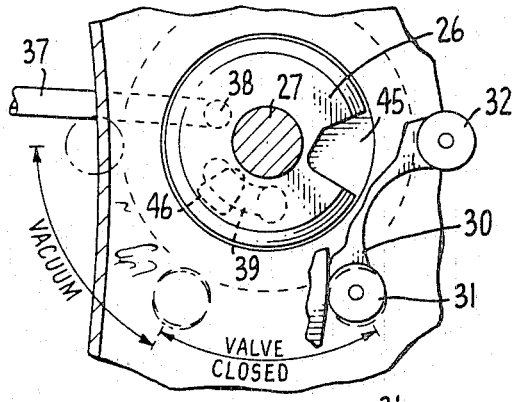
FIG. 2 is a top plan view of the valve mechanism of FIG. 1.
Figure 1:
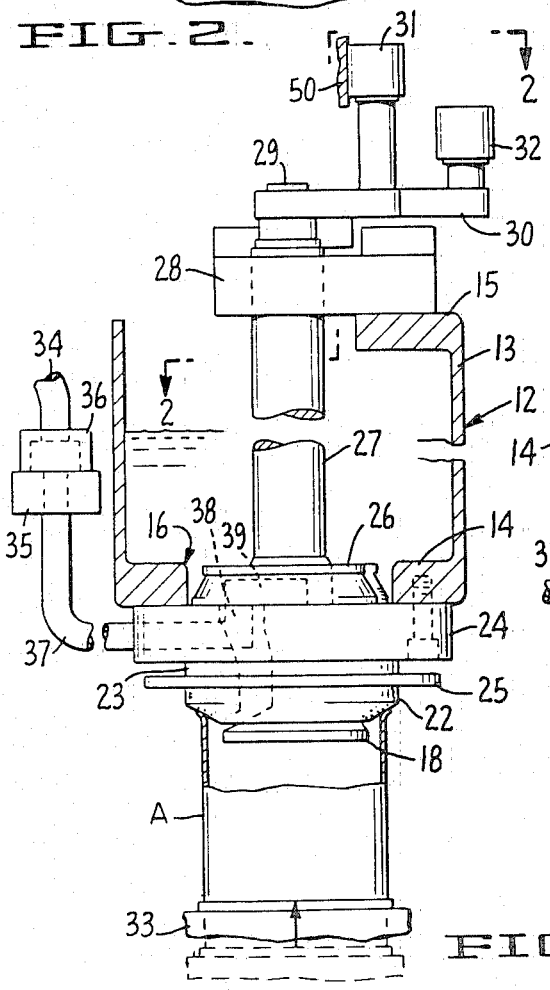
FIG. 1 illustrates in partial vertical section a typical filler valve in closed position with an empty can raised into filling engagement.
Figure 3:
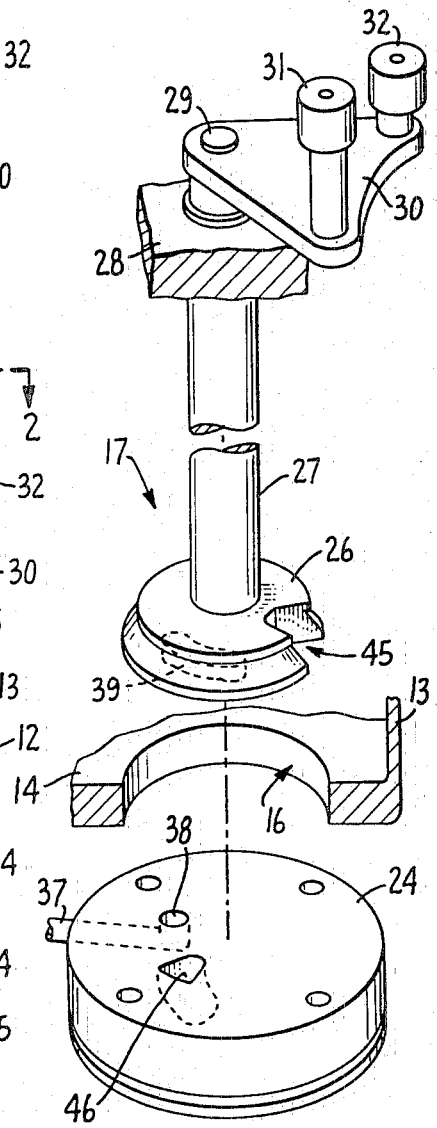
FIG. 3 is an exploded perspective view of the principal filler valve components illustrated in FIGS. 1 and 2.

FIGS. 1, 2 and 3 illustrate a filling valve of the general type shown, for example, in Loveland U.S. Pat. No. 3,990,487. Comparable components in these drawings are numbered according to the numbering in that patent. The illustrated machine includes a rotatable filler bowl 12 which is rotatably mounted and driven upon a stationary frame. The bowl has upwardly extending side walls 13, a bottom 14 and a top rim 15. Around the bottom periphery are a series of openings 16 in which a plurality of filler valves 17 mount. Each filler valve 17 includes a displacement disc 18, a resilient seal ring 22, a splash plate 25 and a spacing washer 23, all mounted upon a ported valve seat 24 that is secured as by the illustrated cap-screws into the bowl bottom 14 to seal off its corresponding opening 16.

A ported valve disc 26 is pivotable upon the valve seat 24 at its lower end and carries valve stem 27 that extends upwardly out of the bowl. The valve stem 27 at its upper end oscillates in journal bearing means 28 fastened as by the illustrated cap-screws to the bowl top rim 15. The upper free end 29 of the valve stem 27 carries a cam follower crank 30 upon which a control cam follower 31 and a switching cam follower 32 are rotatably pinned. These cam followers 31 and 32 track the stationary cam 50 shown and described in connection with FIGS. 4–15.

Vacuum from a vacuum source, not shown, communicates through pipe 34 to a vacuum shoe 36 sliding on perforated plate 35 mounted on the rotatable bowl. The vacuum source draws a vacuum through separate conduit 37 connecting perforated plate 35 and port 38 in each valve seat 24. A fill port 46 in the valve seat 24 communicates with the interior of the filling bowl 12. In the manner which is generally described in more detail in U.S. Pat. No. 3,990,487, control of filling port 46 in the valve seat 24 is by the bottom face of valve disc 26 and its filling port 45 on the disc periphery. Control of the vacuum port 38, which also acts as an atmospheric vent, also is by the bottom face of the valve disc 26 and a passage 39 cut in the bottom which selectively communicates valve seat port 38 with fill port 46 at the vacuuming and vent positions or closes port 38 altogether at the valve closed and fill positions in response to control cam follower 31 and the manipulating cam 50.

Figure 4:
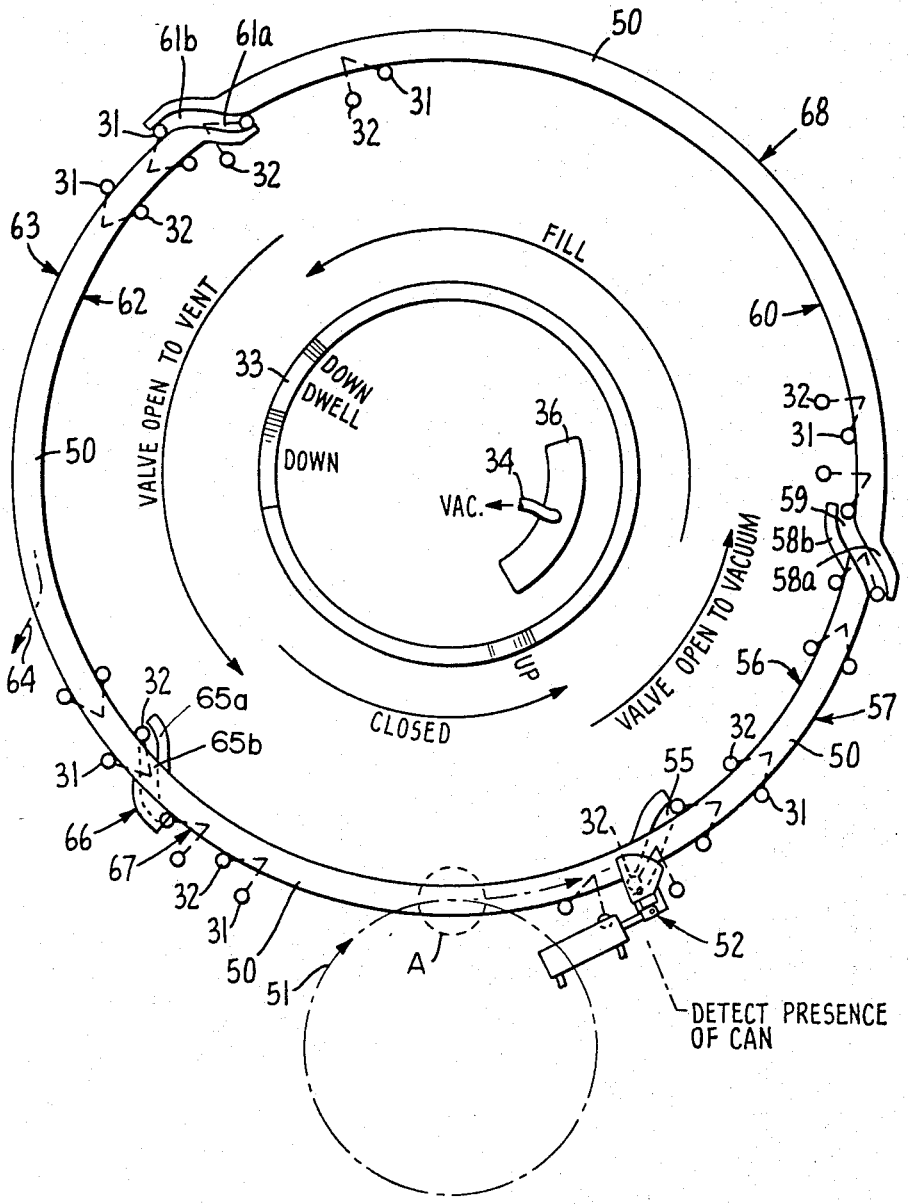
FIG. 4 is a partially schematic plan view of the control cam and switching mechanism illustrating its valve control function in relation to other machine motions.

As is more particularly described in the prior art patents cited earlier, a lift mechanism generally designated as 33 moves an empty can A upwardly into engagement with the resilient seal ring 22 during the vacuum, filling and an initial portion of the vent positions for each filling valve. The up, down, dwell and subsequent down motion for this lifting mechanism is illustrated schematically on FIG. 4. Also, illustrated on FIG. 4 is the control cam 50 which in general oscillates each filler valve stem 27 and valve disc 26 a first 60° increment in one direction to open the valve to vacuum, and then an additional 60° increment in that same direction for duration of the fill. The control cam 50 then reverses the valve motion a first 60° increment to open the valve to atmosphere and then a further 60° increment in the same reverse direction to close the valve and complete its motion sequence.

It will be apparent from a consideration of FIG. 4 that this filling valve motion sequence repeats once for each rotation of the bowl. Cans A are illustrated schematically to be conveyed in a final circular motion along path 51 onto the lifting mechanism 33. As each filler valve passes a can detection station near the end of its closed position, the presence or absence of a can for filling beneath it is sensed and switch means referred to generally as 52 is actuated if there is no can present to maintain that particular valve in the closed position. The detection and switch means is the subject of this invention.

Figure 7:
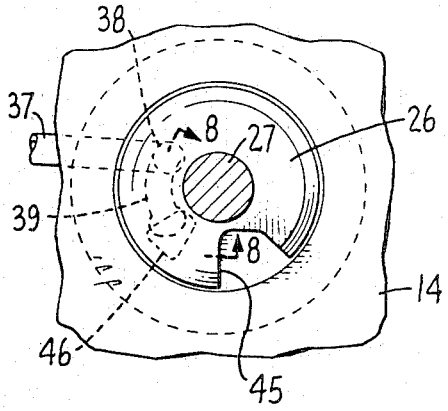
FIG. 7 illustrates in plan the relationship of the valve seat and valve disc ports at the vacuum position.
Figure 8:
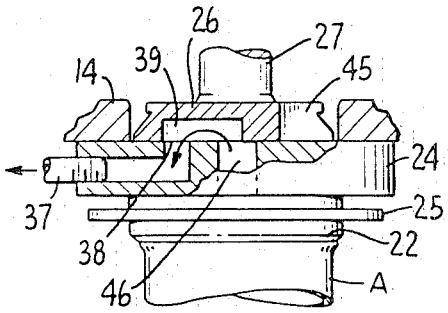
FIG. 8 illustrates in partial vertical section the port relationships of the valve disc and valve seat during the vacuum position of FIG. 7.

The control cam 50 has an upper track for the control cam follower 31 and a lower track for the switching cam follower 32. As shown in FIG. 1 these cam followers are at different elevations. With a can in position for filling as shown in FIG. 1 positioned against the resilient seal ring 22, the switch means 52 guides the switching cam follower 32 into lower track 55 illustrated in FIG. 4 thereby enabling that cam follower to track inner face 56 of the control cam 50 and control cam follower 31 to track the outer face 57 of control cam 50 during a valve vacuum position that is an incremental 60° from the filling valve closed position. At that vacuum position, as is illustrated in FIGS. 7 and 8, conduit 37 and port 38 in the valve seat 24 communicate via passage 39 cut in the bottom face of valve disc 26 with fill port 46 in the valve seat 24 and hence with the interior of the positioned can A in the general manner as described in connection with FIG. 4 of U.S. Pat. No. 3,990,487. A vacuum is drawn on the can with the vacuum shoe 36, as shown in FIG. 4, during that vacuum position oriented over the perforated plate 35. Perforated plate 35 is circular and rotates with the filler bowl 12 whereas vacuum shoe 36 is stationary and extends circumferentially from the beginning of the valve open to vacuum position to its end as shown on FIG. 4.

Figure 9:
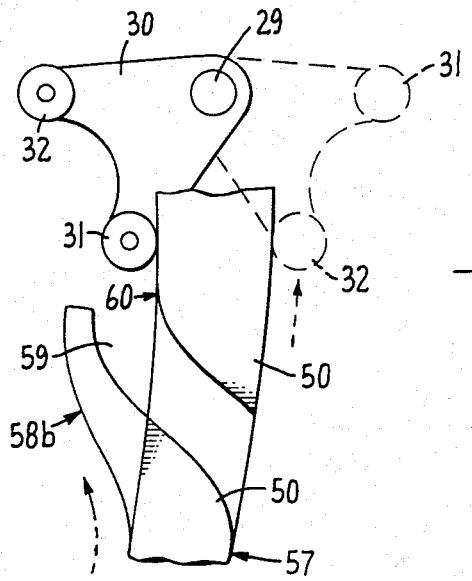
FIG. 9 illustrates in solid lines the cam and cam follower positions at start of the valve fill position with a can in place as shown in FIGS. 10, 11 and in dashed lines without a can in place.
Figure 12:
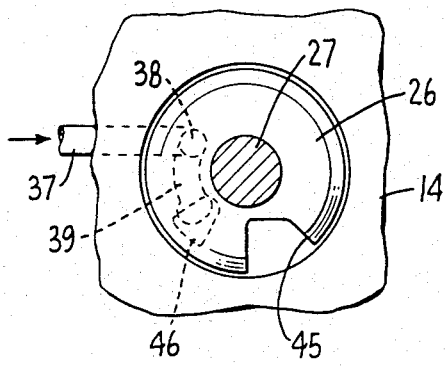
FIG. 12 illustrates in plan the relationship of valve disc and valve seat ports at the vent position.
Figure 10:
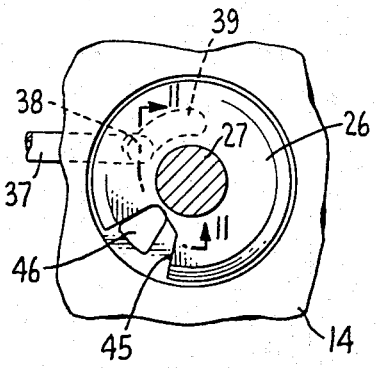
FIG. 10 illustrates in plan the relationship of the valve disc and valve seat ports at the fill position.
Figure 11:
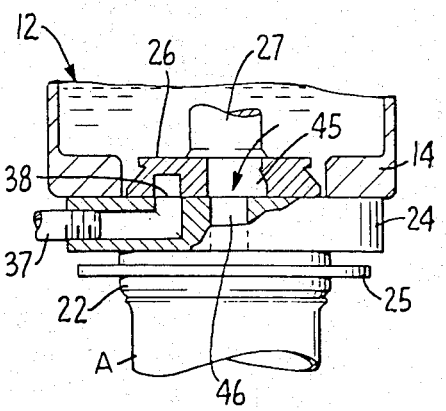
FIG. 11 illustrates in partial vertical section the relationship of the ports of the valve disc and valve seat at the fill position of FIG. 10.

At the end of the vacuum position, control cam 50 by an upper, outwardly extending face **58*a* and track 59 increments the valve disc 26 another 60° in the same direction to the fill position where the control cam follower 31 tracks the inner face 60 of the control cam and the switching cam follower 32 urged outwardly by inwardly extending face 58*b* travels free, as shown in FIG. 9 in solid lines. The valve components are as illustrated in FIGS. 10 and 11 for the fill position. The filling port 45 on the valve disc 26 overlies the fill port 46 in the valve seat 24. The vacuum port 38 of the valve seat is closed. The contents of the bowl 12 in this position flows downwardly through the disc fill port 45 and valve seat fill port 46** into the can A.

We claim:

1. In a filling apparatus for containers having a rotatable multiple station turret, a plurality of filling valves mounted circumferentially around said turret and rotatable therewith, means for moving a container into and out of engagement with each filling valve, and a control means for manipulating each of the filling valves in a repeating sequence through closed, vacuum, fill and vent positions, the improvement wherein said control means comprises:

a plurality of cam followers, one cam follower connected to each filling valve;

a stationary camming means extending at least partially around said turret and being engagable by said cam followers;

a switching cam engagable by said cam followers for initiating a sequence for operating each filling valve but only if a container is present for filling;

actuating means for moving said switching cam between positions of "fill" and "no fill;"

first sensing means for detecting the presence of a container beneath each filler valve that approaches the switching cam;

second sensing means for detecting the presence of a filler valve approaching the switching cam; and circuit means responsive to said first and second sensing means for operating said actuating means.

2. The filling apparatus of claim 1, said actuating means comprising a double acting fluid cylinder connected to said switching cam, a solenoid valve for selectively applying a source of fluid pressure to one or the other ends of said cylinder, said solenoid being operated and controlled by said first and second sensing means and said circuit means.

3. The filling apparatus of claim 2, said circuit means comprising a pair of switches responsive to said first and second sensing means for operating said solenoid and directing a source of fluid pressure to one or the other ends of said cylinder, the closure of one switch placing the switching cam in position for filling a container, the closure of said other switch placing the switching cam in position for bypassing the filling operation sequence.

4. The filling apparatus of claim 2, said circuit means being responsive to said first and second sensing means to change the position of the switching cam but only in response to changes in the simultaneous response of said first and second sensing means.

5. The filling apparatus of claim 1, said switching cam being pivotally mounted and movable between two positions and having a camming track for receiving each of said cam followers in either of its two positions.

* * * * *

CERTIFICATE OF CORRECTION

Patent No. 4,544,005 Dated October 1, 1985

Inventor(s) KONRAD E. MEISSNER and JOHN W. COLOMBO

It is certified that error appears in the above-identified patent and that said Letters Patent are hereby corrected as shown below:

Column 4, Line 17 insert the following paragraphs before the words "We claim:" :

At the end of the fill operation upper, inwardly extending face 61a and another track 61b on the control cam 50 move control cam follower 31 in the opposite direction for a 60° increment and rotate the valve disc 60° to open the valve to atmosphere. In that position the switching cam follower 32 pivots to track inner face 62 of the control cam 50 and the control cam follower 31 follows the outside cam face 63. As mentioned before, the can lifting mechanism moves downward at the start of venting, dwells and then moves downwardly again to ultimately discharge the filled and vented can, as indicated in Fig. 4 at 64. In this vent position, shown in Fig. 12, passage 39 in the bottom face of the valve disc 26 again communicates port 38 in the valve seat with its fill port 46. Conduit 37, however, in this position communicates to atmosphere through perforated plate 35 which in the vent position is open to atmosphere without the overlying vacuum shoe 36.

Finally, control cam 50 moves each filler valve to its closed position as the switching cam follower 32 engages lower, inwardly extending face 65a and moves into lower track 65b onto outer the upper outwardly extending cam face 67 and cam face 66 moves the control cam follower 31 outwardly until it runs free of the cam during the valve closed position. During this portion of the valve sequence, the switching cam follower 32 tracks

CERTIFICATE OF CORRECTION

Patent No. 4,544,005 Dated October 1, 1985

Inventor(s) KONRAD E. MEISSNER and JOHN W. COLOMBO

It is certified that error appears in the above-identified patent and that said Letters Patent are hereby corrected as shown below:

the outside face 67 of the control cam 50 to complete the valve motion sequence.

Figure 6:
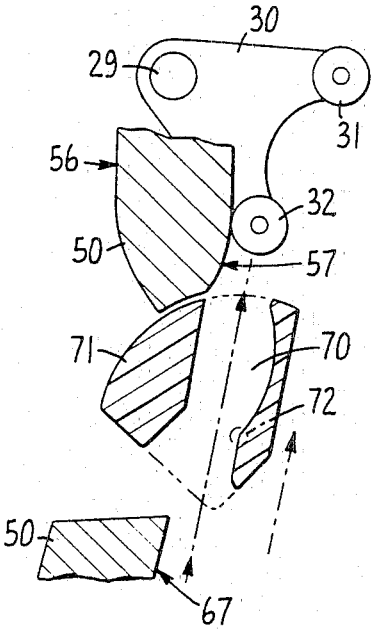
FIG. 6 illustrates the switching cam follower and switch relationship at their positions when a can is not present beneath the particular filler valve.

In order to de-activate the described valving action if no can is present in filling position underneath a particular filler valve such as is shown in Fig. 1, the can detection and switch mechanism 52 switches the switching cam follower 32 then traveling along cam face 67 as shown in Fig. 6 so that it continues to track the outer face of the control cam as at 57, 68, 63 and 67. As indicated, the control cam and switching cam followers 31,32 are at different elevations as is shown in Figs. 2 and 3 so that when no can is present switching cam follower 32 continues outwardly to track the outer faces of the control cam for one revolution until it returns to the can detection station near the end of the closed position shown in Fig. 4. The upper tracks defined at 59 and 61 on the control cam 50 are at an elevation corresponding to control cam follower 31 and the lower tracks 55 and 65 are at an elevation corresponding to the lower switch cam follower 32.

Figure 15:
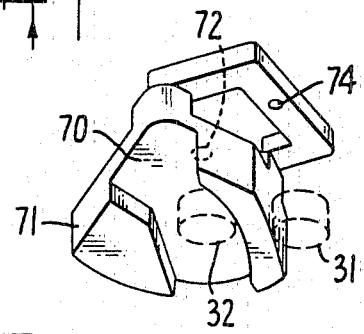
FIG. 15 illustrates in perspective a bottom view of the cam follower and switch relationship shown schematically in FIGS. 13 and 14.

The switch mechanism includes a switchable track 70 formed in a pivotable switch element 71 that pivots at pin 72 from a mounting plate fixed to the stationery control cam support. The track 70 is at an elevation corresponding to that of switching cam follower 32. The control cam follower 31 passes outwardly of the switch element 71 along its outside face as shown in Figs. 4, 15 in either of the switch open or closed positions. A manipulative pneumatic cylinder 73 pinned

CERTIFICATE OF CORRECTION

Patent No. 4,544,005 Dated October 1, 1985

Inventor(s) KONRAD E. MEISSNER and JOHN W. COLOMBO

Figure 5:
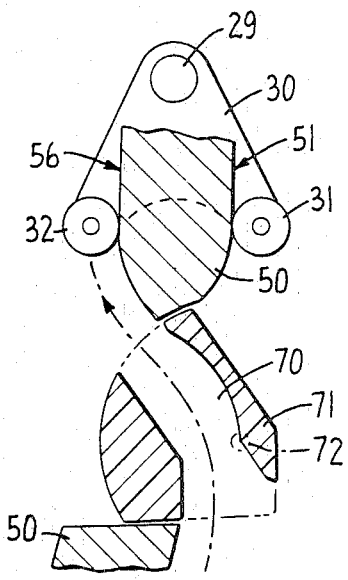
FIG. 5 illustrates the switching cam follower and switch relationship at the positions assumed to commence vacuum draw when a can is present beneath the particular filler valve.
Figure 13:
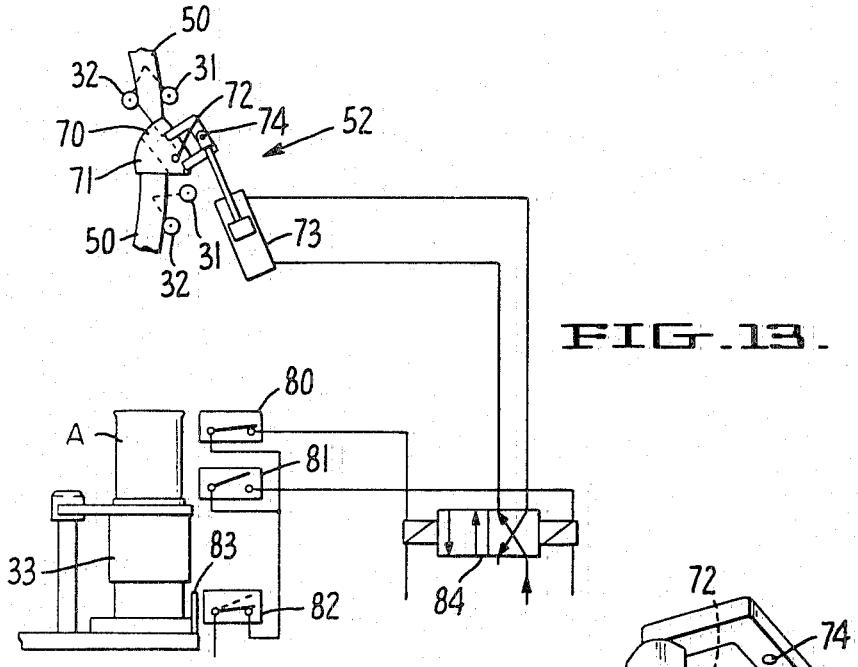
FIG. 13 illustrates schematically the components of the can detection and switch mechanism in their positions when a can has been detected below the particular following valve.
Figure 14:
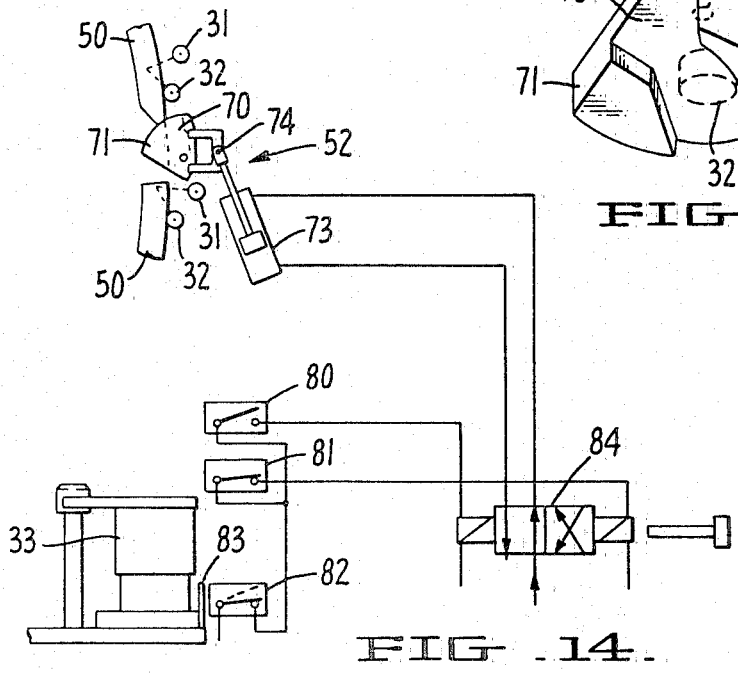
FIG. 14 schematically illustrates the can detection and switch mechanism in their position when a can has not been detected below the particular following valve.

It is certified that error appears in the above-identified patent and that said Letters Patent are hereby corrected as shown below:

to element 71 at 74 moves the switch into its can in place position shown in Figs. 5, 13 or its no-can present position shown in Figs. 6, 14 by means of the system shown schematically in Figs. 13 and 14.

In the can-in-place condition shown in Fig. 13, the metallic can A changes the inductance of an electric field generated by proximity sensors 80, 81 mounted adjacent to the can position on support mechanism 33. The can A passing normally open sensor 80 and normally closed sensor 81 changes the inductance of the magnetic field of each closing the relay of sensor 80 and opening the relay of sensor 81. At substantially the same time, proximity sensor 82 is closed by the presence of a metallic can station target 83 mounted at each can location on support mechanism 33. Concurrent closure of the relays for sensors 81 and 82 connected in series enables solenoid valve 84 which opens the air supply to actuate pneumatic cylinder 73 and move track 70 of switch element 71 into the can in place position shown in Figs. 5, 13. The switching cam follower 32 for the sensed valve with the can in place beneath it then moves through track 70 and track 55 to inner face 56 of the control cam 50. The control cam follower tracks face 57 of the control cam 50 as the manipulative sequence for the filling valve commences as hereinbefore described.

If cans continue to be detected in place for the following filling valve positions, no movement of the switch element 71 or cylinder 73 occurs. However, if an empty can position moves in front of sensors 80, 81 and 82, the circuit through

UNITED STATES PATENT OFFICE

CERTIFICATE OF CORRECTION

Patent No. 4,544,005 Dated October 1, 1985

Inventor(s) KONRAD E. MEISSNER and JOHN W. COLOMBO

It is certified that error appears in the above-identified patent and that said Letters Patent are hereby corrected as shown below:

sensors 81 and 82 is completed and solenoid valve 84 and pneumatic cylinder 73 move element 71 to the position shown in Figs. 6, 14 and the switching cam follower 32 for that particular valve follows track 70 directly from outside cam face 67 to outside cam faces 57,68,63,67 and the valve sequence for that particular filler valve is de-activated. If a series of empty can places follows, again no movement of the air cylinder 73 takes place until a can is present. Then the switch track 70 again closes to direct the switching cam follower 32 for that filling valve through tracks 70,55 onto cam face 56 as described above.

Signed and Sealed this

Eleventh Day of November, 1986

*Attest:*

DONALD J. QUIGG

*Attesting Officer* *Commissioner of Patents and Trademarks*